United States Patent [19]

Leogrande et al.

[11] 4,153,386

[45] May 8, 1979

[54] AIR COOLED TURBINE VANES

[75] Inventors: John A. Leogrande, West Hartford; Richard Levine, Bloomfield, both of Conn.

[73] Assignee: United Technologies Corporation, Hartford, Conn.

[21] Appl. No.: 531,632

[22] Filed: Dec. 11, 1974

[51] Int. Cl.[2] ..... F01D 5/18

[52] U.S. Cl. ..... 415/115; 415/117

[58] Field of Search ..... 416/97, 96, 96 A; 415/115, 116, 117, 178

[56] References Cited

U.S. PATENT DOCUMENTS

| | | | |
|---|---|---|---|
| 3,369,792 | 2/1968 | Kraimer et al. | 415/115 |
| 3,782,852 | 1/1974 | Moore | 415/115 |
| 3,799,696 | 3/1974 | Redman | 416/96 A |
| 3,930,748 | 1/1976 | Redman et al. | 416/97 A |

FOREIGN PATENT DOCUMENTS

| | | | |
|---|---|---|---|
| 491903 | 4/1953 | Canada | 416/96 A |

*Primary Examiner*—Stephen C. Bentley
*Attorney, Agent, or Firm*—Robert C. Walker

[57] ABSTRACT

A turbine vane for use in a gas turbine engine having high turbine inlet temperatures is disclosed. Film cooling is provided at the leading edge of the vane airfoil by cooling air which flows through leading edge holes from a hollow cavity in the airfoil section. Film cooling air is also provided through wall holes along the suction and pressure sides of the airfoil. A U-shaped insert having a pressure leg and a suction leg is disposed within the hollow cavity to isolate the leading edge holes from the wall holes. When the cavity is pressurized, the legs are each urged against corresponding seal ribs which extend from the cavity wall to effectively isolate the leading edge holes.

7 Claims, 4 Drawing Figures

AIR COOLED TURBINE VANES

BACKGROUND OF THE INVENTION

1. Field of the Invention

The present invention relates to gas turbine engines and more particularly to vanes for use in engines having high turbine inlet temperatures.

2. Description of the Prior Art

The design and construction of gas turbine engines has always required precise engineering to ensure the structural integrity of the individual components. One particularly critical area for concern is the turbine nozzle which includes a plurality of vanes disposed across the flowpath of the high temperature gases which are discharged from the combustion chamber during operation. The side walls of adjacent vanes form a plurality of individual nozzles through which the hot gases flow. The flowing gases are directed circumferentially by the nozzles onto the blades of a rotating turbine wheel. The temperature of the combustion gases in the vicinity of the vanes normally exceeds the allowable temperature limit of the material from which the vanes are fabricated. Consequently, the vanes are cooled to reduce the operating metal temperature and prolong their service life.

Cooling air to the vanes is supplied from the compressor section of the engine. Commonly, compressor exit air is flowed from a port at the inner diameter of the working medium gas path through various conduit means to the turbine section of the engine. Each vane commonly has a hollow cavity within the airfoil section which receives the cooling air. A typical vane utilized in cooled turbines is shown in U.S. Pat. No. 3,628,880 to Smuland et al. In Smuland a baffle is inserted into a hollow cavity at the leading edge of a vane airfoil section. Cooling air is directed by small diameter holes in the baffle to impinge upon the cavity walls and, subsequently, is flowed over the outer walls of the airfoil section via leading edge holes in the airfoil wall to film cool the outer surfaces of the vane.

Film cooling requires a precise but relatively low pressure drop across the flow emitting holes at the leading edge. If the pressure drop is too great the emitted flow penetrates the passing working medium and is deflected downstream with the combustion gases without establishing a film layer on the airfoil surface. On the other hand if the pressure drop is too small the hot combustion gases penetrate the cooling air layer to cause destructive heating of the vane material. Impingement cooling, however, requires a high pressure across the baffle insert in order to accelerate the flow to impinging velocities at the airfoil section wall. In order to establish the required baffle pressure drop, the pressure within the hollow cavity must be significantly higher than the pressure of the working medium to which the impinging flow is exhausted.

To implement the conjunctive use of impingement and film cooling, continuing efforts are being directed to provide apparatus which will isolate cooling air to the leading edge holes from the exhaust holes to the working medium for the impingement flow.

SUMMARY OF THE INVENTION

The primary object of the present invention is to provide a turbine vane having a nearly uniform temperature along the walls of the airfoil section including apparatus for precisely controlling the flow of cooling air to the airfoil leading edge.

The present invention is predicated upon the recognition that the absolute pressure of the working medium varies according to the medium position along the exterior walls of the turbine vanes. Specifically, the pressure adjacent the suction side of the airfoil is less than the pressure adjacent the pressure side of the airfoil with both pressures decreasing in the downstream direction from the leading edge to the trailing edge of the airfoil. The cooling requirements of the airfoil are most critical in the region of the leading edge where the working medium pressures are the highest and the thermal environment is the hottest. A positive and measured flow of cooling air must exude from the leading edge of the airfoil before a uniform airfoil section temperature can be achieved.

According to the present invention a U-shaped insert having a pressure leg and a suction leg is disposed within a hollow pressurized cavity in the airfoil section of a turbine vane having leading edge cooling holes, the pressure leg of the insert being in line contact with a seal rib extending from the pressure wall of the cavity and the suction leg being in line contact with a seal rib extending from the suction wall of the cavity; the legs of the insert are urged against the sealing ribs of the cavity by pressure forces within the cavity during operation of the engine to form a sealed internal cavity in gas communication with the cooling holes of the leading edge.

A primary feature of the present invention is the effective combination of film cooling at the leading edge of a turbine vane with impingement cooling along the airfoil walls. A U-shaped sheet metal insert isolates the film cooling holes of the leading edge from the exhaust holes to the working medium for the impingement flow in the suction wall of the airfoil. Another feature of the present invention is the first and second sealing ribs against which the suction and pressure legs of the U-shaped insert are urged by pressure forces within the cavity during operation of the engine. Standoff protrusions extending from the inner walls of the cavity restrain the insert which deflects under the influence of pressure forces to provide a controlled width passageway between the insert and the inner walls of the cavity.

A principal advantage of the present invention is the formation of a sealed cavity feeding the leading edge holes of the airfoil. Air supplied to the sealed cavity flows through the leading edge holes into the gas path rather than flowing within the cavity between the insert and cavity wall, through the suction wall holes, and into the working medium path. When the cavity is pressurized the pressure and suction legs deflect against the standoff protrusions while at all times maintaining line contact with the first and second sealing ribs to prevent cooling air starvation at the leading edge cooling holes. The standoff protrusions are free from contact with the insert during the depressurized condition so that the first contact between the airfoil section and the insert when the cavity is pressurized is always at the sealing ribs.

The foregoing and other objects, features and advantages of the present invention will become more apparent in the light of the following detailed description of the preferred embodiment thereof as shown in the accompanying drawing.

DESCRIPTION OF THE PREFERRED EMBODIMENT

Figure 1:
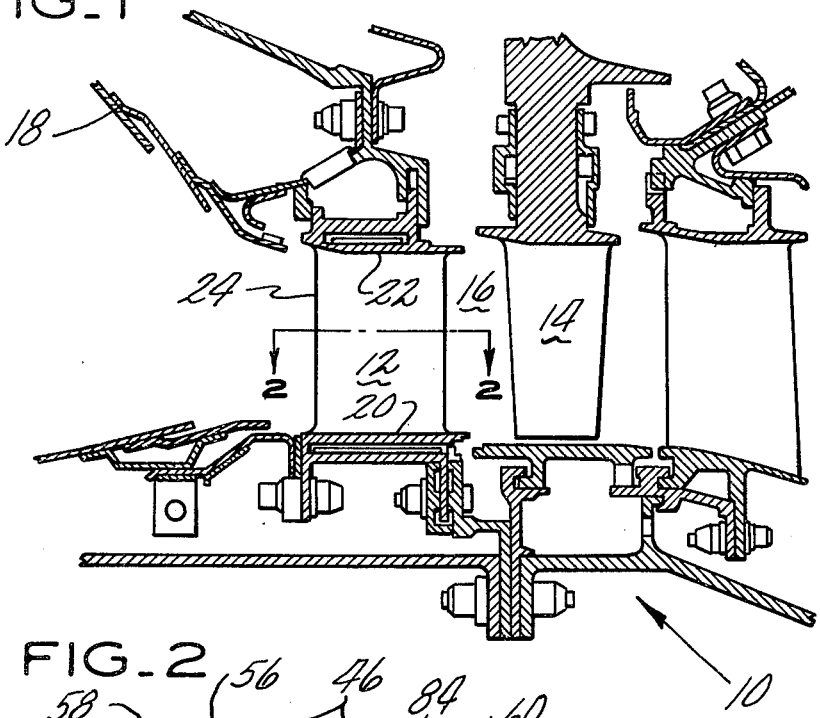
FIG. 1 is a simplified cross-sectional view of a portion of a gas turbine engine showing a vane at the inlet to the turbine.

A portion of the turbine section of a gas turbine engine 10 is shown in cross section in FIG. 1. A nozzle guide vane 12 and a turbine blade 14 are disposed within an annular flowpath 16 of combustion gases discharging from a combustion chamber 18. The nozzle guide vane is one of a row of vanes which are located at the same axial position within the annular flowpath. Similarly, the turbine blade is one of a row of turbine blades disposed within the flowpath immediately downstream of the vanes. Each guide vane has an outer diameter base 20 and an inner diameter base 22 which support an airfoil section 24 extending between the outer and inner bases.

Figure 2:
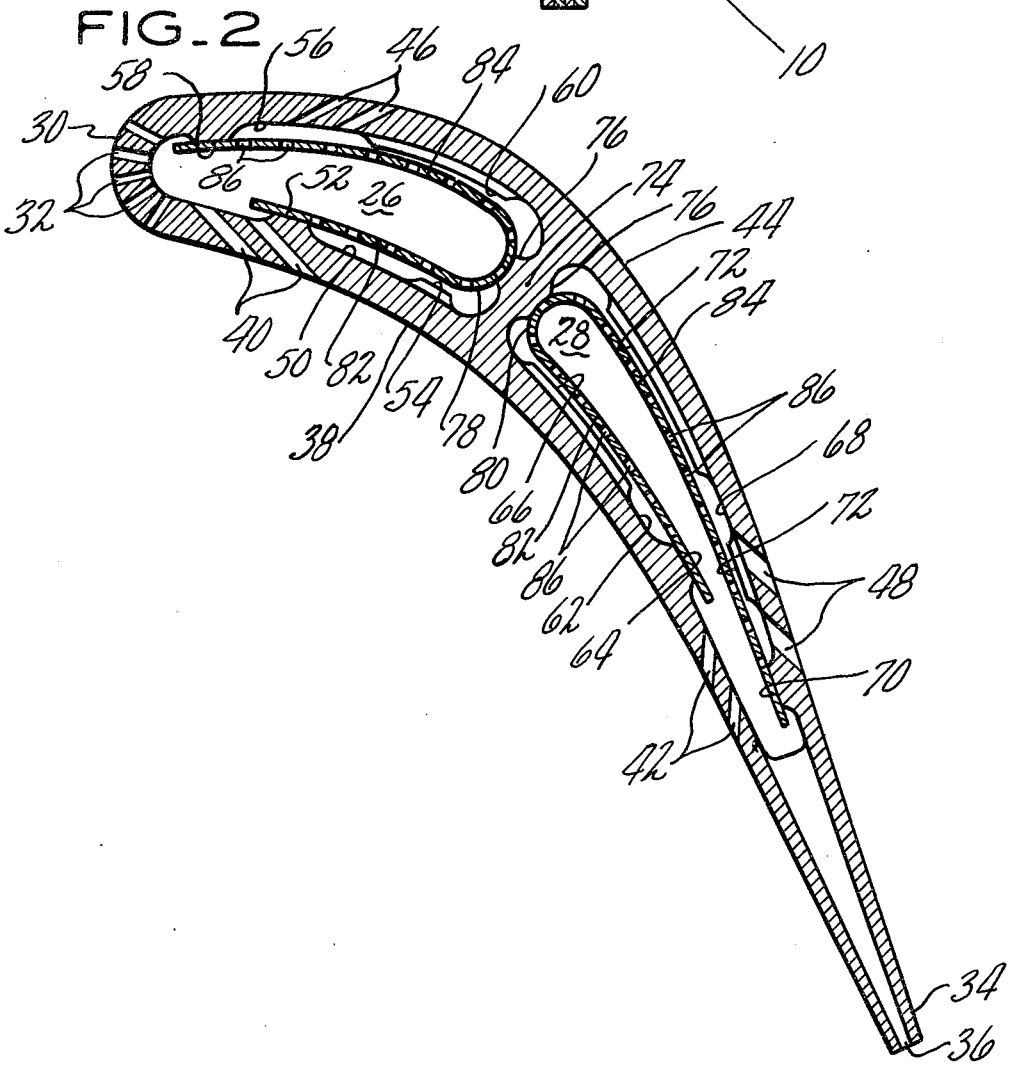
FIG. 2 is a cross-sectional view of the turbine vane taken along the line 2—2 of FIG. 1.
Figure 3:
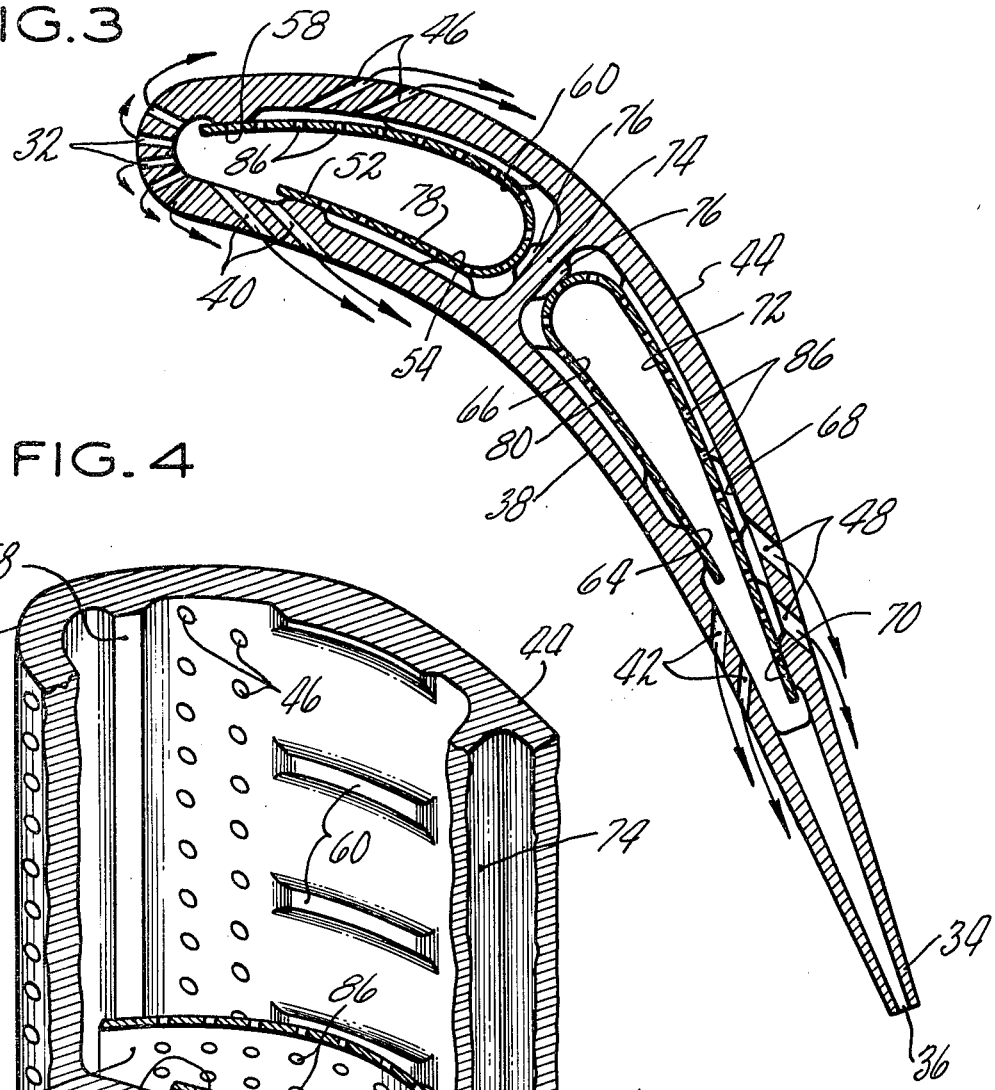
FIG. 3 is a cross-sectional view of the vane showing the internal arrangement when under pressure.
Figure 4:
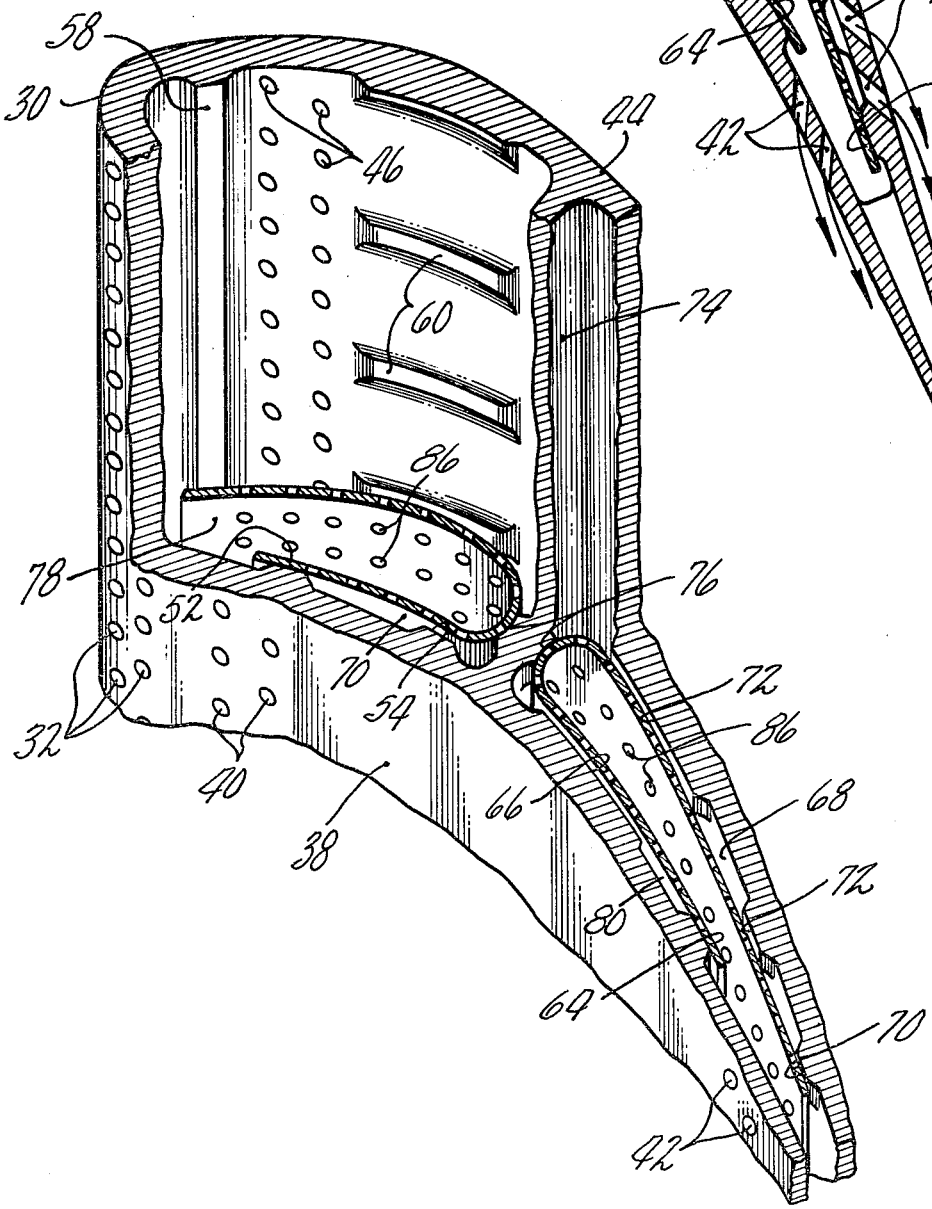
FIG. 4 is a partially cut away isometric view of the vane shown in FIG. 2.

As is shown in FIG. 2 each airfoil section has a leading edge cavity 26 and a trailing edge cavity 28. A leading edge 30 of the airfoil section faces in the upstream direction and includes leading edge cooling holes 32 which are disposed therein between the inner and outer bases. The leading edge cooling holes connect the leading edge cavity 26 with the annular flowpath 16. The airfoil section has a trailing edge 34 including a trailing edge cooling hole 36. The trailing edge cooling hole shown is but one of a plurality of trailing edge cooling holes disposed along the trailing edge between the inner and outer bases. The trailing edge holes connect the trailing edge cavity 28 with the annular flowpath 16. Each airfoil section has a pressure side 38 including a first plurality of pressure side cooling holes 40 connecting the leading edge cavity 26 with the annular flowpath and a second plurality of pressure side cooling holes 42 connecting the trailing edge cavity 28 with the annular flowpath. Each airfoil section further has a suction side 44 including a first plurality of suction side cooling holes 46 connecting the leading edge cavity 26 to the annular flowpath 16 and a second plurality of suction side cooling holes 48 connecting the trailing edge cavity 28 to the annular flowpath.

The leading edge cavity 26 has a pressure wall 50 including a pressure wall sealing rib 52 and a pressure wall standoff 54 projecting from the wall. Although only a single pressure wall standoff 54 is shown in FIG. 2 a plurality of standoffs are located at the same axial position along the cavity wall. The leading edge cavity 26 further has a suction wall 56 including a suction wall sealing rib 58 and a suction wall standoff 60. Although only a single suction wall standoff 60 is shown in FIG. 2, several suction wall standoffs are positioned at the same axial position along the wall. The trailing edge cavity 28 has a pressure wall 62 including a pressure wall sealing rib 64 and a pressure wall standoff 66 projecting from the wall. Although a single pressure wall standoff is shown in FIG. 2, several pressure wall standoffs are located at the same axial position along the pressure wall. The trailing edge cavity also has a suction wall 68 including a suction wall sealing rib 70 and a suction wall standoff 72 projecting therefrom. Although only a single suction wall standoff is shown in FIG. 2, several suction wall standoffs are located at the same axial position along the suction wall. The leading and trailing edge cavities are separated by a cross member 74 having a plurality of cross member standoffs 76 projecting into each cavity. A leading edge insert 78 and a trailing edge insert 80 which have substantially U-shaped contours, are disposed within the leading edge cavity 26 and a trailing edge cavity 28 respectively. Each insert has a pressure leg 82 which opposes the pressure wall of the respective cavity and a suction leg 84 which opposes the suction wall of the respective cavity. A plurality of impingement cooling holes 86 penetrate the leading and trailing edge inserts.

During operation of the gas turbine engine, air is compressed within a compressor section and flowed to a combustion chamber where a portion of the compressed gases is mixed with fuel to form a combustable mixture which is burned to increase the kinetic energy of the flowing gases. It is desired to burn the combustable mixture at high temperatures in order to decrease the amount of unburned hydrocarbons which are discharged from the combustion chamber. The desired combustion temperatures greatly exceed the maximum allowable temperature to which downstream metallic components can be exposed and dilution air from the compressor section is, therefore, admitted to the downstream portion of the combustion chamber. In one typical modern engine the dilution air mixes with the combustion gases to reduce the maximum temperature of local gases entering the turbine in the takeoff engine condition to approximately three thousand degrees Fahrenheit (3,000° F.) at a static pressure of three hundred thirty-two pounds per square inch absolute (332 psia). The row of nozzle guide vanes which are disposed within the annular flowpath of the combustion gases at the inlet to the turbine forms a turbine nozzle which directs the flowing gases at a preferred angle into the row of turbine blades 14. The airfoil section 24 of each vane is contoured to direct the flow of combustion gases into the turbine blades as described above. A concave surface on the pressure side 38 of the vane receives the downstream flowing combustion gases and imparts a circumferential component to the flow direction. A convex surface on the suction side 44 of the adjacent vane opposes the pressure side of the airfoil section and conjunctively forms an individual turbine nozzle. In the typical engine previously discussed, the static pressure of the flowing gases along the pressure side of the airfoil section is three hundred twenty-nine pounds per square inch absolute (329 psia). The static pressure on the opposing suction side of the adjacent airfoil is two hundred sixty-nine pounds per square inch absolute (269 psia) and the static pressure at the trailing edge of the airfoil section is two hundred fifty two pounds per square inch absolute (252 psia).

The cooling requirements for the guide vane are most critical in the region of the leading edge 30 where the temperature and the pressure of the working medium are the highest. Cooling air from the compressor of the gas turbine engine described above is supplied to the leading edge cavity 26 at a pressure which is approximately three hundred thirty-five pounds per square inch absolute (335 psia) or 99 percent (99%) of the working medium pressure at the leading edge of the airfoil during the takeoff condition. Film cooling at the leading edge is well known as a most effective means for avoiding high metal temperatures in this region. Where film cooling is utilized, a steady supply of cooling air is emitted at a low velocity from the leading edge cooling holes 32. The emitted cooling air is deflected by the hot gases of the working medium in the axially downstream direction along the walls of the surface to be cooled. If the pressure drop along the leading edge cooling holes 32 is too high, the flow velocities will also be too high causing the cooling air to penetrate turbulently the flow of working medium, mix with the hot medium gases, and dissipate the cooling capacity of the film. Conversely, where the flow velocity is insufficient, the working medium gases will penetrate the film and contact the metallic surfaces of the airfoil section.

Once the proper proportion of cooling flow to working medium flow and the proper flow velocities are determined by methods well known in the art, apparatus constructed in accordance with the present invention is utilized to provide and maintain that precise flow.

The leading edge insert 78, which has a substantially U-shaped contour, brackets the leading edge holes 32 and the first plurality of pressure side cooling holes 40. Although the first plurality of pressure side cooling holes is not provided in some constructions, the holes are incorporated in the preferred embodiment shown to increase the boundary layer of film cooling air along the pressure side of the airfoil where the temperatures are the highest. The pressure side cooling holes are isolated along the leading edge cooling holes in order to take advantage of the controlled flow provided at the leading edge holes by the apparatus constructed in accordance with the present invention.

It is also well known in the art that impingement cooling of the interior walls of the airfoil section efficiently supplements the film cooling of the airfoil section as previously described. Contrary to the pressure differential requirements for film cooling, the impingement cooling systems require a substantial pressure drop between the cooling supply cavity and the surface to be cooled in order that the cooling air can be accelerated to a velocity at which the air will impinge upon the cooled wall. Concomitantly, the impingement cooling air must be exhausted to a relatively low pressure in order to maintain the substantial pressure drop between the supply cavity and the cooled surface. In this preferred embodiment a region of substantially decreased pressure within the working medium flowpath is found along a suction wall of the airfoil section and the impingement cooling flow is exhausted accordingly thereto.

Impingement cooling of the interior walls and film cooling of the exterior walls are combined efficiently in the preferred embodiment apparatus. Film cooling flow which is emitted at the leading edge holes is isolated from the impingement flow which is exhausted through the first plurality of suction cooling holes 46 to the annular flowpath 16. It is imperative that a positive flow of cooling air exude from the leading edge cavity through the leading edge cooling holes in order to establish a film cooling barrier at the leading edge. Where local cooling flow is interrupted, the airfoil becomes exposed to the high temperature gases and will ultimately be destroyed. Isolating the flow to the leading edge ensures that a proper proportion of cooling air is directed to the leading edge cooling holes rather than to the region of lesser pressure along the suction side of the airfoil section. Starvation of cooling air in the leading edge region is prevented.

The pressure leg 82 and the suction leg 84 of the leading edge insert 78 are deflected within the leading edge cavity against the pressure wall sealing rib 52 and the suction wall sealing rib 58 respectively. As can be seen in FIG. 2, the sealing ribs are located on opposing sides of the leading edge cooling holes 32 and, in this specific embodiment, also bracket the first plurality of pressure side cooling holes 40 on the pressure side of the airfoil. The multiplicity of standoffs are provided along the interior walls of the airfoil section to space the deflected insert from the corresponding airfoil walls at a predetermined distance. High velocity air flows across the predetermined distance to impinge upon and cool the interior walls of the airfoil section. When the cavity is depressurized, the walls of the U-shaped insert resiliently return to an interior position spaced apart from the standoffs. Contact between the insert legs and the corresponding sealing ribs is maintained during the depressurized condition and said contact is undisturbed by premature contact of the insert legs against the standoffs as the cavity becomes pressurized. Additionally the standoffs space the U-shaped insert apart from the interior walls of the airfoil section to form a plurality of passageways. The passageways conduct the flow of cooling air along the interior walls to convectively cool the walls.

The leading edge insert is manufactured from thin sheet metal, preferably within the thickness range of eight thousandths to ten thousandths of an inch (0.008 to 0.010) although a thickness of four thousandths to twenty thousandths (0.004 to 0.020) of an inch may be utilized depending upon the pressure differentials, temperatures, and length of the insert legs involved. The insert is inherently flexible and is manufactured free of ribs or other surface discontinuities which would add stiffness to the sheet metal member. The insert is sized to provide an interference fit between the sheet metal insert and the sealing ribs against which the insert rests, the insert being pinched only at the points of contact at the sealing ribs during the nonoperating condition. The U-shaped insert affords significant improvements over the former box-type impingement baffles described in the prior art. In the box-type construction a closed tube is inserted into the cavity with an interference fit between the sealing ribs and the box-type structure. Because the box-type structure is inherently rigid, line sealing contact between the ribs and the impingement tubes is not attained. In the preferred embodiment line sealing contact between the insert and the corresponding sealing ribs is attained and the flow of cooling air along the wall of the cavity between the insert and the sealing rib is prevented.

The trailing edge insert 80 functions within the trailing edge cavity 28 in a manner similar to the functioning of the leading edge insert within the leading edge cavity. However in the preferred embodiment construction described, the pressure drop across the trailing edge cavity walls is greater than the pressure drop across the leading edge cavity walls and it has been accordingly determined that a trailing edge insert thickness of eleven thousandths to thirteen thousandths (0.011 to 0.013) of an inch is preferred.

Although the invention has been shown and described with respect to a preferred embodiment thereof, it should be understood by those skilled in the art that various changes and omissions in the form and detail thereof may be made therein without departing from the spirit and the scope of the invention.

Having thus described a typical embodiment of our invention that which we claim as new and desire to secure by Letters Patent of the United States is:

1. In a cooled turbine vane having a hollow airfoil section including a leading edge having a plurality of leading edge cooling holes in gas communication with the hollow portion thereof, a pressure side, and a suction side having a plurality of suction side holes in gas communication with the hollow portion thereof, the improvement comprising:

a substantially U-shaped insert having a pressure side leg and a suction side leg, the insert being disposed within the hollow portion of the airfoil section; and means located within the hollow portion of the airfoil section, including a first sealing rib on the suction side of the airfoil section between the suction side holes and the leading edge cooling holes and a second sealing rib on the pressure side of the airfoil section adjacent to the leading edge holes, for isolating cooling flow to the leading edge holes from flow to the suction side holes, the suction and pressure legs of the insert being adapted to seal against the first sealing rib and second sealing rib respectively in operative response to the internal pressure within the hollow portion of the airfoil section.

2. The invention according to claim 1 wherein the U-shaped insert has a multiplicity of impingement cooling holes which penetrate the pressure and suction legs of the insert.

3. The invention according to claim 2 wherein the U-shaped insert has a thickness within the range of four to twenty thousandths of an inch.

4. The invention according to claim 2 wherein the U-shaped insert has a thickness within the range of eight to ten thousandths of an inch.

5. The invention according to claim 2 further including within the hollow portion of the airfoil section means, comprising a plurality of standoffs extending from the suction and pressure sides of the hollow portion, for spacing the suction and pressure legs of the U-shaped insert apart from the suction and pressure sides of the hollow portion respectively.

6. A cooled turbine vane structure having a leading edge cavity and a trailing edge cavity and comprising:

an airfoil section including a trailing edge, a pressure side, a suction side having a first plurality of cooling holes in communication with the leading edge cavity and a second plurality of cooling holes in communication with the trailing edge cavity and a leading edge having a plurality of leading edge cooling holes;

a leading edge insert which has a substantially U-shaped contour and which is disposed within the leading edge cavity, the insert having a pressure leg, a suction leg and a multiplicity of cooling holes which penetrate the suction and pressure legs of the insert;

a trailing edge insert which has a substantially U-shaped contour and which is disposed within the trailing edge cavity, the insert having a pressure leg, a suction leg and a multiplicity of cooling holes which penetrate the suction and pressure legs of the insert;

means located within the leading edge cavity including a first sealing rib on the suction side of the airfoil section between the suction side holes and the leading edge cooling holes and a second sealing rib on the pressure side of the airfoil section adjacent to the leading edge holes for isolating cooling flow to the leading edge holes from flow to the suction side holes, the suction and pressure legs of the insert being adapted to seal against the first sealing rib and second sealing ribs respectively in operative response to the internal pressure within the hollow cavity; and means located within the trailing edge cavity including a first sealing rib on the suction side of the airfoil section between the suction side holes and the trailing edge cooling holes and a second sealing rib on the pressure side of the airfoil section adjacent to the trailing edge holes, for isolating cooling flow to trailing edge holes from flow to the suction side holes, the suction and pressure legs of the insert being adapted to seal against the first sealing rib and second sealing rib respectively in operative response to the internal pressure within the hollow cavity.

7. The invention according to claim 6 wherein the leading edge insert has a material thickness within the range of eight thousandths to ten thousandths and the trailing edge insert has a material thickness within the range of eleven thousandths to thirteen thousandths of an inch.

* * * * *